US005631518A

United States Patent [19]

Barker

[11] Patent Number: 5,631,518

[45] Date of Patent: May 20, 1997

[54] ELECTRON SOURCE HAVING SHORT-AVOIDING EXTRACTION ELECTRODE AND METHOD OF MAKING SAME

[75] Inventor: Dean Barker, Chandler, Ariz.

[73] Assignee: Motorola, Schaumburg, Ill.

[21] Appl. No.: 433,884

[22] Filed: May 2, 1995

[51] Int. Cl.[6] ..... H01J 1/46

[52] U.S. Cl. ..... 313/308; 313/309; 313/336; 313/497; 445/24

[58] Field of Search ..... 313/495, 497, 313/308, 309, 336, 351; 445/24, 49

[56] References Cited

U.S. PATENT DOCUMENTS 4,270,068 5/1981 Kishino et al. ..... 313/497
5,142,184 8/1992 Kane ..... 313/336
5,170,092 12/1992 Tomii et al. ..... 313/309
5,194,780 3/1993 Meyer .
5,461,396 10/1995 Nakatani et al. ..... 313/497

*Primary Examiner*—Sandra L. O'Shea
*Assistant Examiner*—Matthew J. Esserman
*Attorney, Agent, or Firm*—Eugene A. Parsons

[57] ABSTRACT

A display (10) includes an electron source having a row conductor (17) that utilizes a plurality of longitudinal elements (26, 28). Each longitudinal element (26, 28) has extraction section (19, 23) that extends from the longitudinal element toward an adjacent longitudinal element. The longitudinal elements (26, 28) are electrically connected by a plurality of transverse connectors (29, 38, 39). When a short occurs between the row (17) and an underlying column (12, 36), the shorted portion can be electrically isolated so that the remainder of the row remains functional.

16 Claims, 1 Drawing Sheet

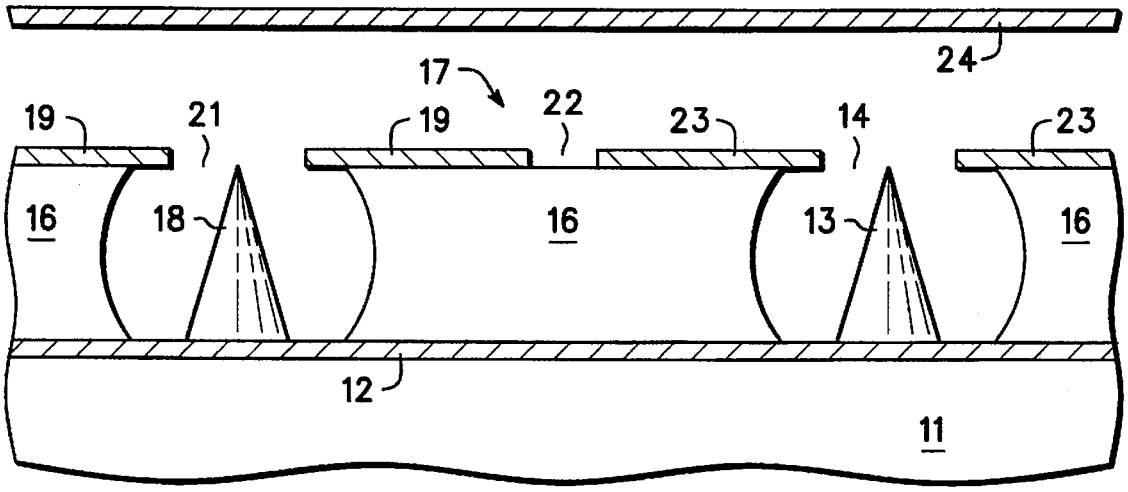
10 FIG. 1
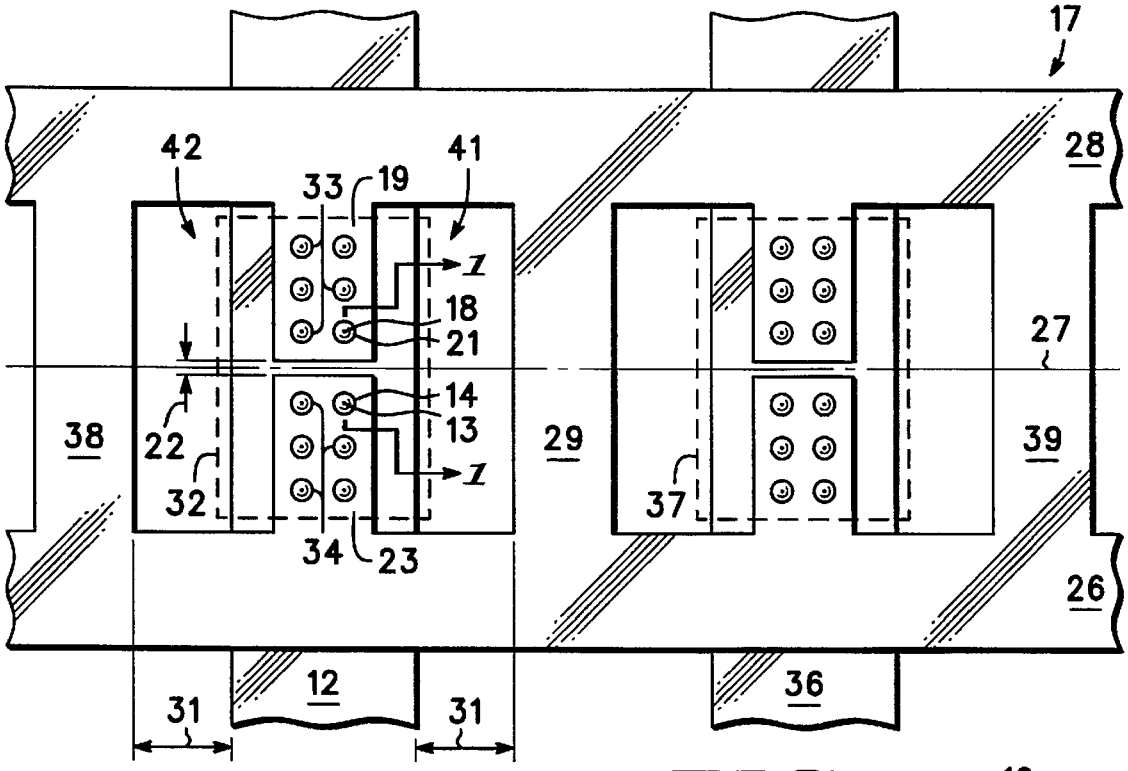
FIG. 2 10

ELECTRON SOURCE HAVING SHORT-AVOIDING EXTRACTION ELECTRODE AND METHOD OF MAKING SAME

BACKGROUND OF THE INVENTION

The present invention relates, in general, to electron emission display devices, and more particularly, to a novel extraction grid for an electron emission source.

Field emission devices (FEDs) are well known in the art and are commonly employed for a broad range of applications including image display devices. An example of a FED is given in U.S. Pat. No. 5,142,184 issued to Robert C. Kane on Aug. 25, 1992. FEDs typically employ at least two electrodes, such as a cathode conductor and a gate or extraction grid. Generally, the extraction grid and the cathode conductor are formed at right angles to facilitate utilizing row and column addressing to stimulate electron emission from emission tips or emitters. The cathode conductor and the extraction grid typically are electrically isolated by a dielectric layer. During the FED formation, pinholes can form in the dielectric layer and result in electrical shorts between the extraction grid and the cathode conductor. Because of the electrical short, the cathode conductor and the extraction grid are forced to the same potential thereby preventing a column of emitters and the row from being energized. The shorted column of emitters can not generate an image, thus, a display device formed with such electrical shorts usually has either a dark or a continually bright line where the shorted rows and columns are positioned.

Accordingly, it is desirable to have an electron source that remains functional if the extraction grid is shorted to the cathode conductor.

BRIEF DESCRIPTION OF THE DRAWINGS

FIG. 1 illustrates an enlarged cross-sectional portion of a display in accordance with the present invention; and FIG. 2 illustrates an enlarged plan view of a portion of the display of FIG. 1 in accordance with the present invention.

DETAILED DESCRIPTION OF THE DRAWINGS

FIG. 1 schematically illustrates an enlarged cross-sectional portion of a pixel of a field emission display 10 that has a novel electron source with a novel extraction grid or row conductor 17. Display 10 typically includes a plurality of such pixels. Display 10 also includes a substrate 11 on which the pixel and other portions of display 10 are formed. Substrate 11 typically is an insulating or a semi-insulating material, for example, silicon having a dielectric layer or glass. In the preferred embodiment, substrate 11 is glass. Display 10 also includes a column conductor or cathode 12 on which a plurality of field emission emitters such as an emitter 13 and an emitter 18 are formed. Cathode 12 typically is a conductor and may include ballast resistors between cathode 12 and emitters 13 and 18.

Row conductor 17 is disposed on a dielectric layer 16 that electrically isolates conductor 17 from substrate 11, and cathode 12. As will be more apparent in the subsequent discussion of FIG. 2, conductor 17 has a plurality of extraction sections such as an extraction section 23 and an extraction section 19 that facilitate improving the manufacturability of display 10. Sections 19 and 23 have emission openings 21 and 14, respectively, that are substantially centered to emitters 18 and 13, respectively, to permit electrons to travel from emitters 13 and 18 to a distally disposed anode 24 and form an image thereon. The surface of anode 24 facing emitters 13 and 18 typically is coated with a phosphor in order to provide a display as electrons strike anode 24.

Display 10 typically includes a plurality of rows, such as row conductor 17, that transverse a plurality of column conductors or cathodes, such as cathode 12, at right angles. Emitters, such as emitters 13 and 18, are formed at the intersections of the rows and columns to create the pixels of display 10. Although only two emitters are shown in the portion of the pixel illustrated in FIG. 1, each pixel of display 10 can have a plurality of emitters, such as emitters 13 and 18, as will be seen hereinafter. Also, display 10 can include a plurality of column conductors, a plurality of rows, as well as a plurality of pixels each having a plurality of extraction sections such as sections 19 and 23.

FIG. 2 illustrates an enlarged plan view of a portion of display 10. Elements of FIG. 2 that are the same as FIG. 1 have the same reference numbers. Row conductor 17 has a plurality of longitudinal elements juxtaposed to one another and extending along a major axis 27 of conductor 17. The plurality of longitudinal elements include a first longitudinal element 26 and a second longitudinal element 28 that traverse cathode 12 in addition to traversing a second column conductor or cathode 36. The portion of conductor 17 overlying the field emission emitters on cathodes 12 and 36 forms a pixel 32 and a pixel 37, respectively. Pixel 32 and 37 are each indicated by a dashed box. Longitudinal elements 26 and 28 each have extraction sections within pixels 32 and 37 that are utilized to facilitate extracting electrons from underlying emitters to form an image on anode 24 (FIG. 1).

In the preferred embodiment, first longitudinal element 26 has a first extraction section 23 within pixel 32 that extends from element 26 toward second longitudinal element 28. Second longitudinal element 28 has a second extraction section 19 within pixel 32 that extends from element 28 toward first extraction section 23. Sections 19 and 23 are separated by a space 22 so there is no electrical contact between sections 19 and 23. In the preferred embodiment, space 22 is approximately two to ten microns. Extraction section 23 has a plurality of emission openings 34 that function similarly to extraction opening 14. Similarly, extraction section 19 has a plurality of emission openings 33 that function similarly to emission opening 21.

Row conductor 17 also has a plurality of transverse connectors that includes a first transverse connector 29, a second transverse connector 38, and a third transverse connector 39 that are utilized to electrically connect longitudinal elements 26 and 28. The plurality of transverse connectors permit electrically isolating a portion of conductor 17 without destroying the functionality of conductor 17. For example, if the portion of element 28 that overlays cathode 12 is shorted to cathode 12, the shorted portion can be removed from element 28 by severing element 28, for example at points indicated by arrows 41 and 42. This allows the remainder of element 28 to function normally. Connectors 29 and 38 provide an electrical path around the portion of element 28 that is electrically isolated from conductor 17 thereby permitting conductor 17 to function. It is important that connectors 29 and 38 be positioned a distance 31 from cathode 12 in order to ensure that cathode 12 is not damaged when severing or otherwise electrically isolating a portion of conductor 17. In the preferred embodiment, distance 31 is at least approximately five microns.

Although severing the shorted portion of conductor 17 results in pixel 32 creating an image that is not as bright as adjacent pixels, one single half bright pixel will not be noticed in a display, especially if the remainder of conductor 17 functions normally.

As shown in FIG. 2, conductor 17 has a transverse connector for each pixel however, conductor 17 could have a connector for every other pixel or even fewer transverse connectors. Additionally, extraction sections 19 and 23 can be formed in other configurations. For example, sections 19 and 23 could be in the portion of longitudinal elements 28 and 26, respectively, that cross cathode 12 instead of projecting outward from elements 28 and 26. Alternately, extraction sections 19 and 23 could be interdigitized fingers extending from longitudinal elements 26 and 28.

By now it should be appreciated there has been provided a novel electron source that can be utilized to form a display. By utilizing a plurality of longitudinal elements to create a row and interconnecting the longitudinal elements with a transverse connector, non-functioning portions of the row can be severed thereby making the row functional. Consequently, the yield and manufacturability of a display is increased resulting in lower cost displays.

I claim:

1. A electron source comprising:

a column conductor having a plurality of field emission emitters; and a row conductor traversing the column conductor and overlying the plurality of field emission emitters, the row conductor having a plurality of longitudinal elements juxtaposed along a major axis of the row conductor wherein each longitudinal element has an extraction section positioned adjacent to a portion of the plurality of field emission emitters, and a plurality of transverse connectors electrically coupling the plurality of longitudinal elements together.

2. The electron source of claim 1 wherein each extraction section is separated by a space.

3. The electron source of claim 1 wherein the emitters include conically shaped tips and the extraction section defines an opening around and in a plane including each tip.

4. The electron source of claim 3 wherein each transverse connector is separated from the column conductor by a distance.

5. The electron source of claim 4 wherein the distance is at least approximately five microns.

6. The electron source of claim 1 wherein the plurality of longitudinal elements includes a first longitudinal element having a first extraction section overlying a first portion of the plurality of field emission emitters and a second longitudinal element having a second extraction section overlying a second portion of the plurality of field emission emitters.

7. The electron source of claim 6 wherein the first extraction section extends from the first longitudinal element toward the second longitudinal element and the first extraction section overlays the first portion of the plurality of field emission emitters, and wherein the second extraction section extends from the second longitudinal element toward the first extraction section wherein the second extraction section overlays the second portion of the plurality of field emission emitters.

8. The electron source of claim 7 further including a space separating the first extraction section and the second extraction section.

9. The electron source of claim 1 wherein each extraction section has emission openings to permit electron transit through the emission openings.

10. A display comprising:

a plurality of column conductors;

a plurality of field emission emitters on each column conductor; and a plurality of row conductors overlying the plurality of column conductors and crossing the plurality of column conductors forming a pixel at an intersection therewith, each row conductor having a first longitudinal element along a major axis, a second longitudinal element juxtaposed to the first longitudinal element, a first extraction section within the pixel and extending from the first longitudinal element toward the second longitudinal element wherein the first extraction section overlays a first portion of the plurality of field emission emitters, a second extraction section within the pixel and extending from the second longitudinal element toward the first extraction section wherein the second extraction section overlays a second portion of the plurality of field emission emitters, a space separating the first extraction section and the second extraction section, and a plurality of transverse connectors extending from the first longitudinal element to the second longitudinal element wherein each transverse connector is spaced longitudinally from the pixel and each of the plurality of column conductors.

11. The display of claim 10 wherein the space is approximately two to ten microns.

12. The display of claim 10 wherein each transverse connector is separated from a column conductor of the plurality of column conductors by a distance.

13. The display of claim 12 wherein the distance is sufficient to permit severing of at least one of the plurality of row conductors without damaging the column conductor.

14. The display of claim 12 wherein the distance is at least approximately five microns.

15. A method of forming an electron source comprising:

forming a column conductor having a plurality of emitters;

forming a row conductor having a plurality of conductor strips traversing the column conductor and defining extraction elements positioned adjacent the emitters; and electrically coupling the plurality of conductor strips together with a plurality of transverse conductors that extend between the plurality of conductor strips sufficiently far from the column conductor that severing one of the plurality of conductor strips does not damage the column conductor while maintaining the electrical coupling between the plurality of conductor strips.

16. The method of claim 15 wherein electrically coupling the plurality of conductor strips together includes electrically coupling the plurality of conductor strips together a distance of at least approximately five microns from the column conductor.

* * * * *